US005267863A

United States Patent [19]

Simmons, Jr.

[11] Patent Number: 5,267,863

[45] Date of Patent: Dec. 7, 1993

[54] INTERLOCKING PIXEL BLOCKS AND BEAMS

[76] Inventor: Felix J. Simmons, Jr., 10153½ Riverside Dr., Box 237, Toluca Lake, Calif. 91602

[21] Appl. No.: 955,410

[22] Filed: Oct. 2, 1992

[51] Int. Cl.[5] ..... A63H 33/08

[52] U.S. Cl. ..... 434/96; 446/127; 446/85

[58] Field of Search ..... 446/102, 104, 116, 117, 446/118, 119, 128, 125, 115, 120-122, 124, 127, 85; 273/153 R, 155, 156, 157 R; 434/96, 403

[56] References Cited

U.S. PATENT DOCUMENTS

| | | | |
|---|---|---|---|
| 3,466,044 | 9/1969 | Somerville | 273/157 R |
| 3,981,506 | 9/1976 | Daniel et al. | 273/157 R |
| 3,987,558 | 10/1976 | Tsukamoto | 434/96 |
| 4,021,939 | 5/1977 | May | 434/403 |
| 4,053,159 | 10/1977 | Kulak | 273/157 R |
| 4,111,425 | 9/1978 | Lathrop | 273/157 R |
| 4,189,151 | 2/1980 | Klopfenstein | 273/156 |
| 4,208,811 | 6/1980 | Junowicz | 434/96 |
| 4,332,387 | 6/1982 | Mullen | 273/156 |
| 4,398,890 | 8/1983 | Knowlton | 434/96 |
| 4,605,231 | 8/1986 | Richman | 273/155 R |
| 4,650,437 | 3/1987 | Sitkus | 446/128 |

FOREIGN PATENT DOCUMENTS

| | | | |
|---|---|---|---|
| 861372 | 12/1962 | Fed. Rep. of Germany | 446/127 |
| 1273609 | 9/1961 | France | 446/127 |
| 239230 | 1/1946 | Switzerland | 446/124 |
| 2054391 | 2/1981 | United Kingdom | 446/124 |

*Primary Examiner*—Gene Mancene
*Assistant Examiner*—L. Thomas
*Attorney, Agent, or Firm*—J. E. McTaggart

[57] ABSTRACT

Interlocking blocks are configured to serve as basic picture elements and beams ("pixels and sticks") for creating a variety of two- and three-dimensional graphic artifacts. The pixel blocks have a substantially square cross-section and may be made in cubes or in beams of various length. The four sides of the square cross-section are made identical, each side defining a tongue alongside a groove in a symmetrical complementary configuration such that adjacent blocks can be slidingly interlocked together to form one- and two-dimensional arrays; thus cubes, or blocks of uniform length, can form two-dimensional artifacts and blocks of various lengths can form three-dimensional artifacts. By utilizing the blocks in a variety of visual properties such as color and light transmission, quantities of the blocks and/or beams may be interlocked together to form pictures, graphics patterns, and other artifacts. Using computerized scanning of an original object, pixel data of the original may be acquired and stored; from this data, artifacts may be assembled automatically from pixel blocks to produce either a likeness, or, with data manipulation, a graphically-stylized rendition. For manual assembly, acquired pixel data may be utilized to generate a pixel map and a corresponding kit of blocks having different properties in the correct quantities, for use in industrial assembly, education, therapy, home hobbies, and such involving users of all ages.

15 Claims, 6 Drawing Sheets

9 PLACES

| | | | | | | | | | | | | | | | | | | | | | | | |
|---|---|---|---|---|---|---|---|---|---|---|---|---|---|---|---|---|---|---|---|---|---|---|---|
| 27 | 27 | 27 | 27 | 27 | 28 | 28 | 28 | 28 | 28 | 30 | 30 | 30 | 30 | 30 | 18 | 18 | 18 | 18 | 18 | 18 | 18 | 18 | 18 |
| 27 | 27 | 27 | 27 | 27 | 28 | 28 | 28 | 28 | 28 | 30 | 30 | 30 | 30 | 30 | 18 | 18 | 18 | 18 | 18 | 18 | 18 | 18 | 18 |
| 27 | 27 | 27 | 27 | 27 | 28 | 28 | 28 | 28 | 28 | 30 | 30 | 30 | 30 | 30 | 18 | 18 | 18 | 18 | 18 | 18 | 18 | 18 | 18 |
| 20 | 20 | 20 | 20 | 20 | 20 | 20 | 20 | 20 | 20 | 20 | 20 | 20 | 20 | 20 | 17 | 17 | 17 | 17 | 17 | 17 | 17 | 17 | 17 |
| 20 | 20 | 20 | 20 | 20 | 20 | 20 | 20 | 20 | 20 | 20 | 20 | 20 | 20 | 20 | 17 | 17 | 17 | 17 | 17 | 17 | 17 | 17 | 17 |
| 20 | 20 | 20 | 20 | 20 | 20 | 20 | 20 | 20 | 20 | 20 | 20 | 20 | 20 | 20 | 17 | 17 | 17 | 17 | 17 | 17 | 17 | 17 | 17 |
| 20 | 20 | 20 | 20 | 20 | 20 | 20 | 20 | 20 | 20 | 20 | 20 | 20 | 20 | 20 | 16 | 16 | 16 | 16 | 16 | 16 | 16 | 16 | 16 |
| 20 | 20 | 20 | 20 | 20 | 20 | 20 | 20 | 20 | 20 | 20 | 20 | 20 | 20 | 20 | 16 | 16 | 16 | 16 | 16 | 16 | 16 | 16 | 16 |
| 20 | 20 | 20 | 20 | 20 | 20 | 20 | 20 | 20 | 20 | 20 | 20 | 20 | 20 | 20 | 16 | 16 | 16 | 16 | 16 | 16 | 16 | 16 | 16 |
| 30 | 30 | 20 | 20 | 20 | 20 | 20 | 20 | 20 | 20 | 20 | 20 | 20 | 20 | 20 | 16 | 16 | 16 | 16 | 16 | 16 | 16 | 16 | 16 |
| 30 | 30 | 30 | 20 | 20 | 20 | 20 | 20 | 20 | 20 | 20 | 20 | 20 | 20 | 20 | 15 | 15 | 15 | 15 | 15 | 15 | 15 | 15 | 15 |
| 30 | 30 | 30 | 30 | 20 | 20 | 20 | 20 | 20 | 20 | 20 | 20 | 20 | 20 | 20 | 15 | 15 | 15 | 15 | 15 | 15 | 15 | 15 | 15 |
| 30 | 30 | 30 | 30 | 30 | 20 | 20 | 20 | 20 | 20 | 20 | 20 | 20 | 20 | 20 | 15 | 15 | 15 | 15 | 15 | 15 | 15 | 15 | 15 |
| 30 | 30 | 30 | 30 | 30 | 30 | 20 | 20 | 20 | 20 | 20 | 20 | 20 | 20 | 20 | 14 | 14 | 14 | 14 | 14 | 14 | 14 | 14 | 14 |
| 30 | 30 | 30 | 30 | 30 | 30 | 20 | 20 | 20 | 20 | 20 | 20 | 20 | 20 | 20 | 14 | 14 | 14 | 14 | 14 | 14 | 14 | 14 | 14 |
| 30 | 30 | 30 | 30 | 30 | 30 | 30 | 20 | 20 | 20 | 20 | 20 | 20 | 20 | 20 | 14 | 14 | 14 | 14 | 14 | 14 | 14 | 14 | 14 |
| 30 | 30 | 30 | 30 | 30 | 30 | 30 | 20 | 20 | 20 | 20 | 20 | 20 | 20 | 20 | 14 | 14 | 14 | 14 | 14 | 14 | 14 | 14 | 14 |
| 30 | 30 | 30 | 30 | 30 | 30 | 30 | 20 | 20 | 20 | 20 | 20 | 20 | 20 | 20 | 13 | 13 | 13 | 13 | 13 | 13 | 13 | 13 | 13 |
| 30 | 30 | 30 | 30 | 30 | 30 | 30 | 30 | 20 | 20 | 20 | 20 | 20 | 20 | 20 | 13 | 13 | 13 | 13 | 13 | 13 | 13 | 13 | 13 |
| 30 | 30 | 30 | 30 | 30 | 30 | 30 | 30 | 20 | 20 | 20 | 20 | 20 | 20 | 20 | 13 | 13 | 13 | 13 | 13 | 13 | 13 | 13 | 13 |
| 30 | 30 | 30 | 30 | 30 | 30 | 30 | 30 | 20 | 20 | 20 | 20 | 20 | 20 | 20 | 12 | 12 | 12 | 12 | 12 | 12 | 12 | 12 | 12 |
| 30 | 30 | 30 | 30 | 30 | 30 | 30 | 30 | 20 | 20 | 20 | 20 | 20 | 20 | 20 | 12 | 12 | 12 | 12 | 12 | 12 | 12 | 12 | 12 |
| 29 | 29 | 30 | 30 | 30 | 30 | 30 | 30 | 20 | 20 | 20 | 20 | 20 | 20 | 20 | 12 | 12 | 12 | 12 | 12 | 12 | 12 | 12 | 12 |
| 29 | 29 | 29 | 29 | 30 | 30 | 30 | 30 | 20 | 20 | 20 | 20 | 20 | 20 | 20 | 12 | 12 | 12 | 12 | 12 | 12 | 12 | 12 | 12 |
| 29 | 29 | 29 | 29 | 29 | 30 | 30 | 30 | 20 | 20 | 20 | 20 | 20 | 20 | 20 | 11 | 11 | 11 | 11 | 11 | 11 | 11 | 11 | 11 |
| 29 | 29 | 29 | 29 | 29 | 29 | 30 | 20 | 20 | 20 | 20 | 20 | 20 | 20 | 20 | 11 | 11 | 11 | 11 | 11 | 11 | 11 | 11 | 11 |
| 29 | 29 | 29 | 29 | 29 | 29 | 29 | 20 | 20 | 20 | 20 | 20 | 20 | 20 | 20 | 11 | 11 | 11 | 11 | 11 | 11 | 11 | 11 | 11 |
| 29 | 29 | 29 | 29 | 29 | 29 | 29 | 103 | 20 | 20 | 20 | 20 | 20 | 20 | 20 | 10 | 10 | 10 | 10 | 10 | 10 | 10 | 10 | 10 |
| 29 | 29 | 29 | 29 | 29 | 29 | 103 | 103 | 20 | 20 | 20 | 20 | 20 | 20 | 20 | 10 | 10 | 10 | 10 | 10 | 10 | 10 | 10 | 10 |
| 29 | 29 | 29 | 29 | 29 | 29 | 103 | 103 | 103 | 20 | 20 | 20 | 20 | 20 | 20 | 10 | 10 | 10 | 10 | 10 | 10 | 10 | 10 | 10 |
| 29 | 29 | 29 | 29 | 29 | 103 | 103 | 103 | 103 | 20 | 20 | 20 | 20 | 20 | 20 | 10 | 10 | 10 | 10 | 10 | 10 | 10 | 10 | 10 |
| 29 | 29 | 29 | 29 | 103 | 103 | 103 | 103 | 103 | 20 | 20 | 20 | 20 | 20 | 20 | 9 | 9 | 9 | 9 | 9 | 9 | 9 | 9 | 9 |

*FIG. 7*

INTERLOCKING PIXEL BLOCKS AND BEAMS

FIELD OF THE INVENTION

The present invention relates to graphic arts and more particularly it relates to interlocking blocks and beams configured as basic elements which may be combined to create two- and three-dimensional graphic art works.

1. Background of the Invention

Materials and computer technology advancements have opened up the potential of new approaches to providing building blocks for graphic creations, particularly new creations or stylized reproductions of existing artwork in the form of graphics artifacts structured from pixels (picture elements) of uniform shape, in both two-dimensional and three-dimensional form.

2. Discussion of Prior Art

U.S. Pat. No. 2,472,363 to Blackinton disclosed and claimed a plural set of toy building blocks including a cube having dove-tail ribs, one on each of two contiguous faces, and mating grooves, one on each of the other two sides, for interlocking the blocks together, as distinguished from a square cross-sectional shape with uniform sides. The Blackinton concept, an extension of earlier known building block concepts, was confined to assembling three kinds of blocks to blend into various physical shapes, as opposed to a concept of utilizing visually differentiated blocks of uniform shape as pixels in a graphic artifact. Blackinton's blocks were presumably opaque and uniform in color and finish, and thus did not extend to visual and optical aspects such as color, texture, translucency and transparency, nor was there any motivation for automated concepts such as array mapping.

U.S. Pat. No. 1,531,542 to Cogshall taught the joining of tot blocks by means of grooves and bars extending only to a midpoint.

The building of pictures and designs from blocks using specialized techniques has been described in U.S. Pat. No. 3,464,145 to Martin, U.S. Pat. No. 3,987,558 to Tsukamoto and U.S. Pat. No. 4,398,890 to Knowlton.

OBJECTS OF THE INVENTION

It is a primary object of the present invention to provide a system of interlocking solid blocks for forming an artifact structured as a two-dimensional array of the blocks interlocked together.

It is a further object of the invention to provide an embodiment directed to forming two-dimensional artifacts.

It is another object to provide an embodiment directed to extending a two-dimensional array basis to the forming of three-dimensional artifacts.

It is a further object to originate computerized mapping data from original art designs to serve as instructional material for assembly of artifacts from the blocks of the present invention.

SUMMARY OF THE INVENTION

The above objects have been realized in the present invention by forming pixel blocks to have a substantially square cross-section so that, depending on their length, they form cubes or beams. The four sides of the cross-section are made identical, each side defining a tongue alongside a groove in a complementary configuration such that adjacent blocks can be interlocked together in one- or two-dimensional arrays. Two-dimensional artifacts are formed from identical cube-shaped blocks, while three-dimensional artifacts may be formed by utilizing blocks of various lengths. By providing the blocks in a variety of colors and light properties, i.e. transparent, translucent in various densities, and opaque, large numbers of the blocks may be interlocked together to a create large variety of graphic artifacts such as patterns, pictures, sculpture and the like.

BRIEF DESCRIPTION OF THE DRAWINGS

The above and further objects, features and advantages of the present invention will be more fully understood from the following description taken with the accompanying drawings in which:

FIG. 7 shows an example of a pixel map in which pixels of a graphic artifact are mapped from electronic data storage in a method of using the present invention.

DETAILED DESCRIPTION

Figure 1:
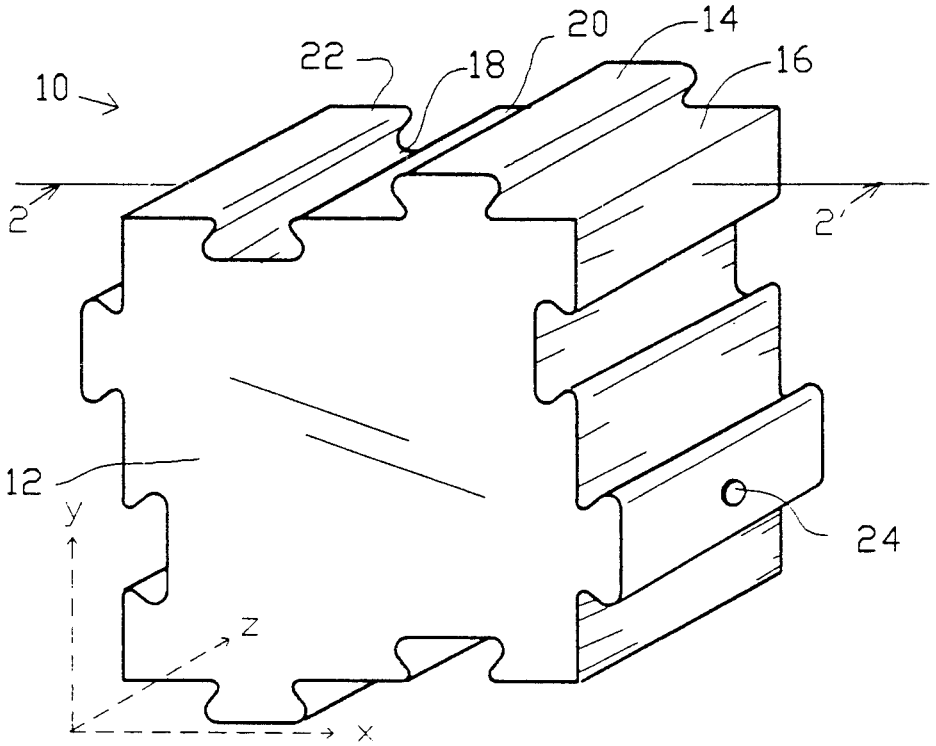
FIG. 1 is a perspective view of a pixel block of the present invention.
Figure 2A:
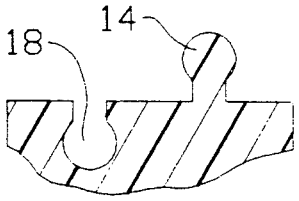
FIGS. 2A–D depict alternative equivalent tongue and groove shapes with which the invention may be practiced.
Figure 2B:
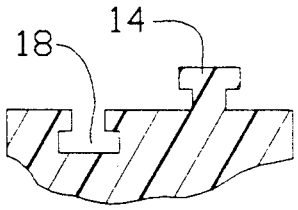
Figure 2C:
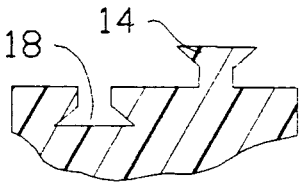
Figure 2D:
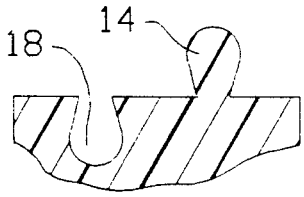

FIG. 1 shows a perspective view of a pixel block 10 of the present invention. The substantially square shape in the x-y plane as seen at the outline of the flat surface 12 remains constant along the z-axis length. The four sides of surface 12 are made identical, each having, as indicated along the top side, a tongue 14 separated from a corner of the block 10 by a flat portion 16, and a groove 18 separated from tongue 12 by a flat portion 20 and separated from an adjacent corner of block 10 by a flat portion 22. The three flat portions 16, 20 and 22 are in a common plane extending between the two adjacent corners of the block 10.

Tongue 14 and groove 18 are made to have near-identical mating outline shapes and are disposed symmetrically about a center line between two adjacent corners of the block as shown. This complementary symmetry, along with enlargement of a portion of the tongue and groove outline shape, allows adjacent blocks to be assembled together in an interlocking manner by a sliding movement along the z axis.

Nub 24 is a small circular protrusion left on each block in at least one surface location as a result of the injection molding of plastic material due to the injection passageway required in the molding die.

The dimension of the central flat portion 20 is not critical, and may even be reduced to zero; however the other two flat portions 16 and 22 are to be made equal.

FIG. 2A–D and FIG. 8 depict five alternative cross-sectional outline shapes for the tongues 14 and grooves 18 as examples of various outline shapes which may be utilized to implement interlocking blocks of the present invention as alternatives to the shape shown in FIG. 1. The basic requirement of this shape is to provide head and neck portions as shown, with sufficient enlargement at the head portion to ensure that attached blocks cannot become detached other than by sliding them apart lengthwise, i.e. along the Z-axis.

Figure 3:
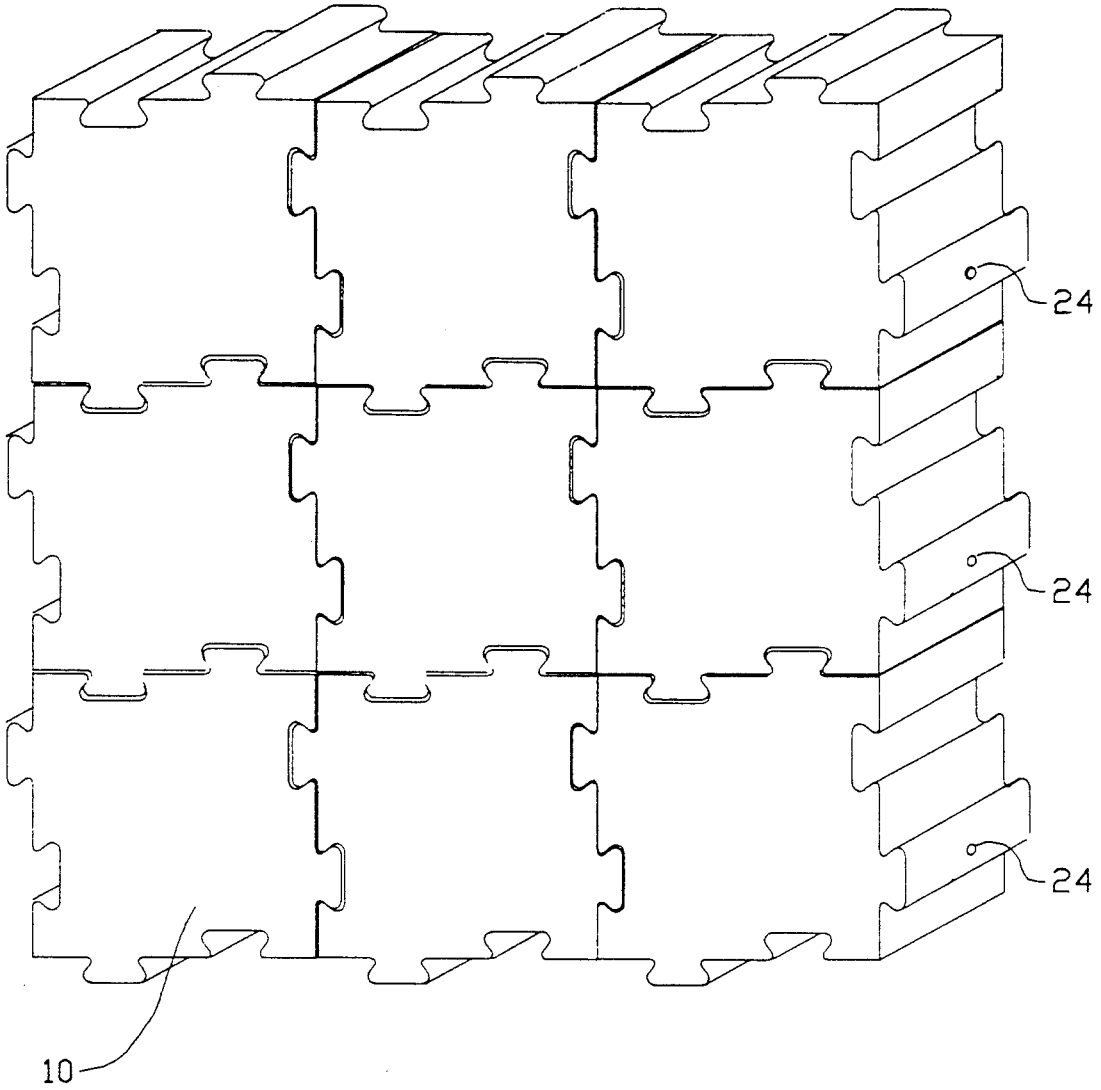
FIG. 3 is a two-dimensional 3×3 array of pixel blocks, such as shown in FIG. 1, interlocked together in accordance with the present invention.

FIG. 3 depicts nine cube-shaped pixel blocks, each as in FIG. 1, interlocked together in a 3×3 array. This array should be considered as an illustrative portion of a two-dimensional graphic artifact which may be extended to any desired size or outline shape by adding on more blocks 10 in the same manner. Blocks 10 are typically made of various colors and light properties, such as clear, translucent, luminescent, etc., and located selectively to act as the pixels of an artifact.

Regarding the molding nubs 24, ordinarily such a nub is undesirable and must be removed at extra cost in an additional manufacturing operation. The present inventor discovered that the nubs 24 may be left in place rather than removed, and utilized to advantage to provide a beneficial friction grip that holds each pixel block 10 tightly gripped to an adjacent block: this greatly facilitates manual assembly, for example in building up a group of pixel blocks 10 in a handheld subassembly to be added to a main assembly in progress. Without the nubs 24, the alternative of trying to obtain a friction fit by specifying a tight clearance between tongues and grooves would be costly and would make attachment slow and difficult. This serendipitous utilization of nubs 24 not only reduces cost by eliminating the manufacturing operation of trimming off the nubs 24, but also facilitates assembly of the blocks 10 and provides superior inter-block retention.

Figure 4:
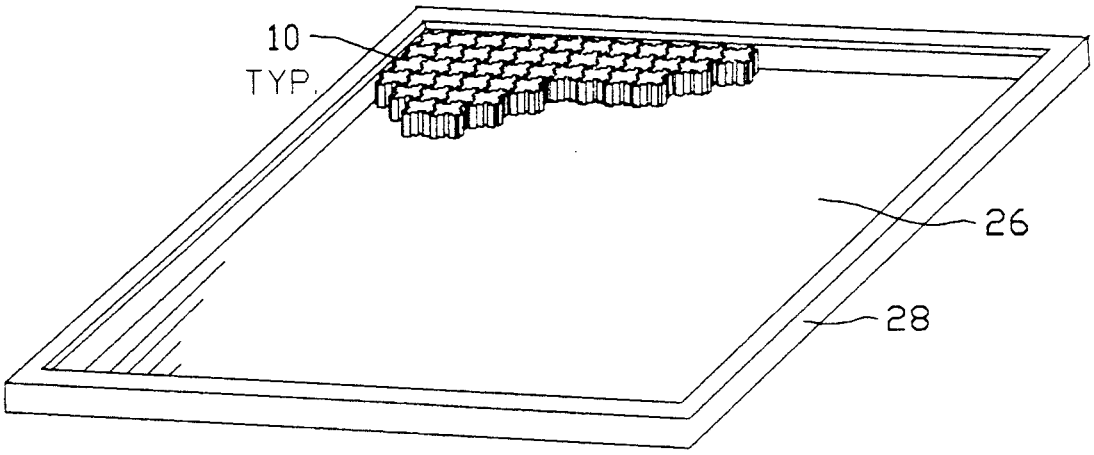
FIG. 4 depicts an array of pixel cubes of the present invention being assembled in a frame.

FIG. 4 depicts a group of pixel blocks 10 of the invention interlocked together in an initial portion of a picture or artwork pattern being assembled on a flat panel 26 surrounded by a frame 28. Blocks 10 are added to the group up to the point of completion of a graphic panel wherein each pixel will be defined by a block 10. Typically in this framed style of two-dimensional backed panel assembly, the blocks are made opaque and of various colors, and are set onto an opaque back panel 26 to which each block 10 may be adhesively fastened. Thus a permanent framed picture or artwork panel is created. Alternatively, panel 26 and frame 28 may be a work fixture; the blocks 10 may be fastened together adhesively as they are assembled and finally removed from the work fixture as a unit which may be framed later or utilized as an unframed piece.

Figure 5:
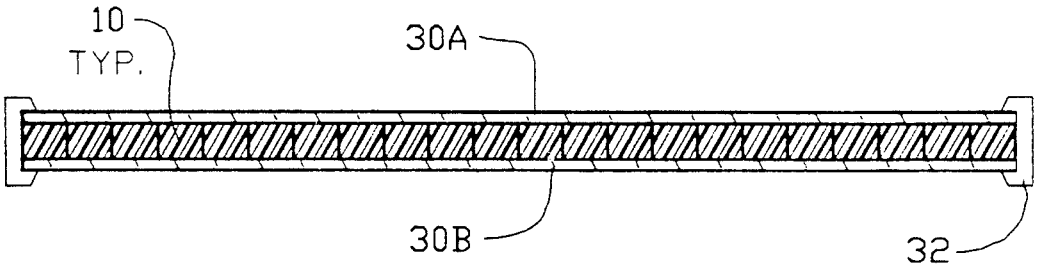
FIG. 5 is a cross-sectional view of a panel of pixel cubes of the invention sandwiched between transparent panels retained in a frame.

FIG. 5 shows a cross section of a two-dimensional panel assembly of pixel blocks 10 sandwiched between a pair of transparent glass or plastic panels 30A and 30B held by a surrounding frame 32; in this configuration, pixel blocks 10 of various selected colors, typically translucent or in some instances transparent, provide a "stained glass window" architectural effect for use in windows of buildings or in artistic panels which may be back-illuminated.

Figure 6:
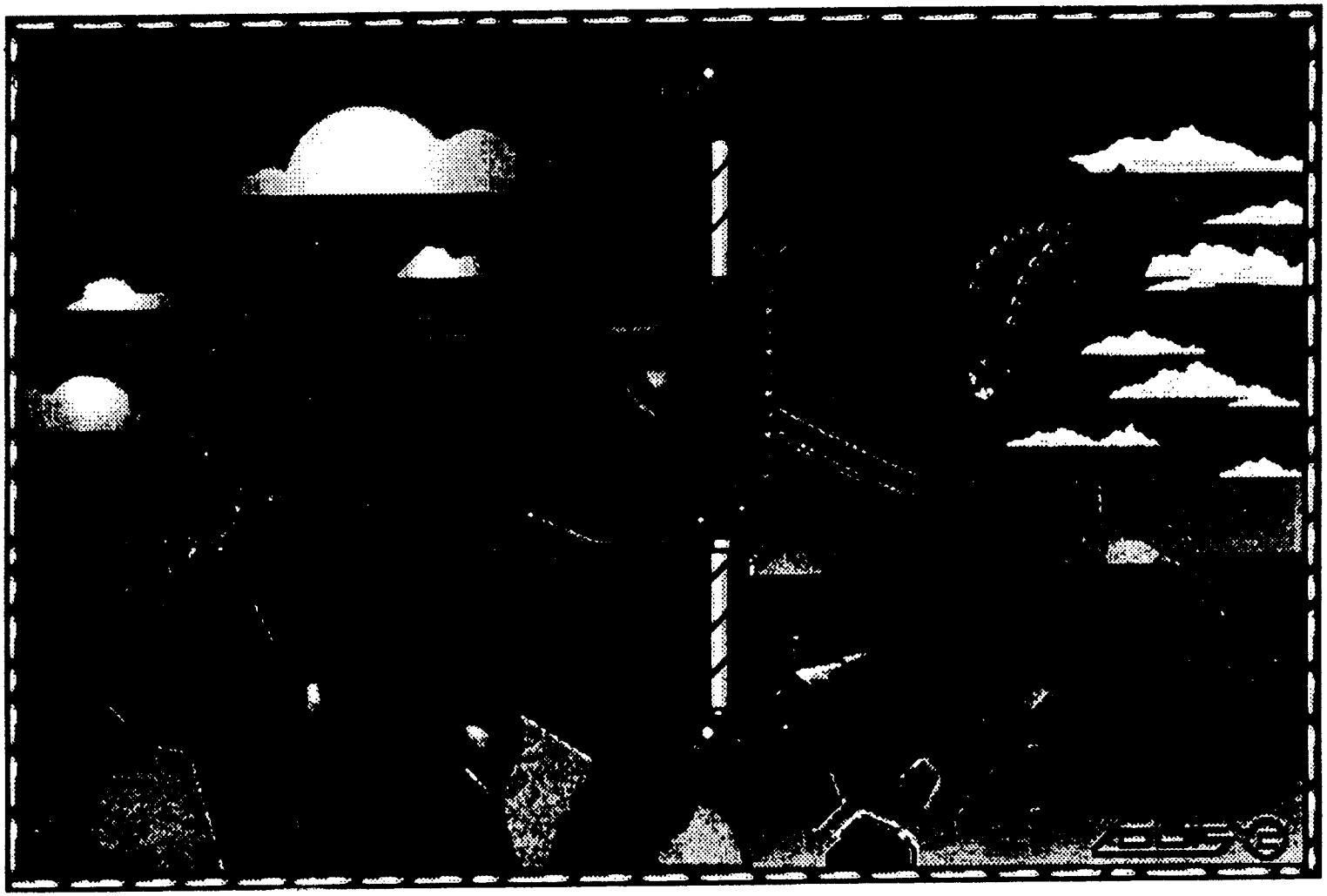
FIG. 6 depicts a graphic artifact formed from pixels which may be implemented as interlocked pixel blocks of the present invention.
Figure 8:
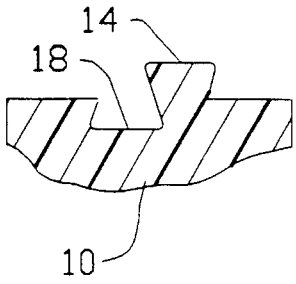
FIG. 8 depicts an alternative tongue and groove attachment pattern.

FIG. 6 is a reproduction of a multi-colored original rendered in pixels as an example of artwork which may be produced by a large array of pixel blocks of this invention. This example is intended to be produced from translucent and transparent pixel blocks enclosed between a pair of transparent panels as shown in FIG. 5 to form a "stained glass" window, but could also be rendered in opaque form, e.g. as shown in FIG. 4.

For two-dimensional arrays such as those of FIGS. 3, 4, 5 and 6, block 10 may be made in the form of a cube by making the z-axis length of block 10 equal to the width and height of the x-y square (not including the tongues 14, FIG. 1). A common size for the cube is ¼" in width, height and length.

FIG. 7 illustrates an X-Y pixel map relating to an aspect of this invention wherein existing graphics source materials, which could include various media as diverse as original paintings or video freeze-frames, are scanned, preferably by computer-automated means, to acquire and store the pixel data in a designated degree of resolution. Such stored data could then be read and printed out in the form of an X-Y pixel map such as the example shown in FIG. 7, where different colors and/or other visual attributes such as light transmission properties are identified numerically to guide manual assembly of artifacts being assembled from pixel blocks. The stored data could also be utilized to render a computer-printed pixel representation of the subject and/or to produce corresponding kits of different pixel blocks in the required quantity breakdowns. Such pixel maps and kits, akin to well known "paint by numbers" products, suggest wide areas of market potential for the present invention in industrial, educational and home environments.

For highly automated or robotic assembly of pixel blocks 10 into artifacts, the stored data may be used in the direct control of assembly mechanisms.

Three-dimensional graphic artifacts may be formed from blocks and beams of the present invention, which may also be referred to as "pixels and sticks". Beams may be extruded from the same plastic material as the blocks in continuous length with the same basic cross sectional shape as the cubic block, from which interlocking beams of various lengths may be cut and assembled together to form a large variety of three-dimensional shapes and art works. In one style of utilizing the beams, they may be all aligned at one end so as to form a base plane. Also, one or both ends of beams may be made in various special shapes other than a standard perpendicular plane cutoff.

Existing original three-dimensional objects may be scanned, for instance with a computerized laser distance-measuring device, to obtain mapped z-axis data on a pixel-by-pixel basis from which pixel beams may be assembled to reproduce the object in three dimensions. This concept may be extended to include other visual attributes such as color.

The scope of the invention also includes providing pixel blocks and beams in various sizes, adapted to particular environments such as in recreational, therapeutic, educational, architectural and structural fields of activity.

In a children's toy embodiment the blocks would made relatively large, non-toxic and configured with special regard to safety.

In a preferred form of the present invention, some or preferably all of the surfaces on each block are made to have a mirror quality surface so as to reflect light and thereby produce in an assembled artifact a distinctive brighter appearing visual effect, especially under specially controlled illumination. For example, in FIG. 1 the flat surface 12 may be made to have a mirror finish.

Figure 9:
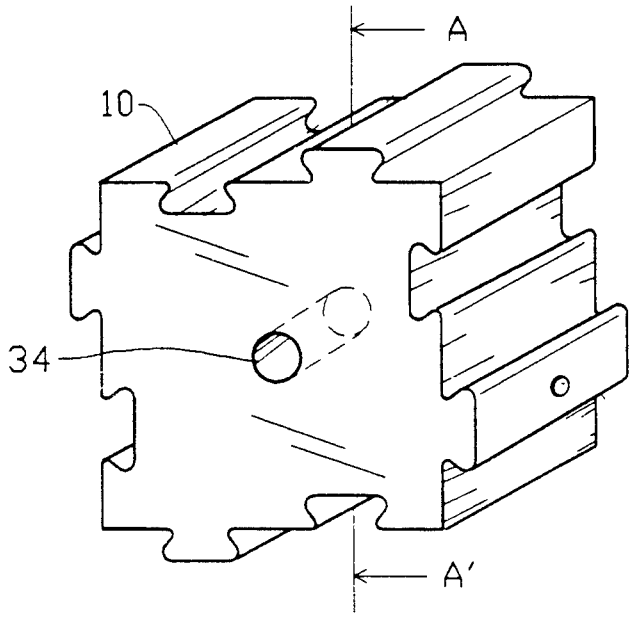
FIG. 9 is a three-dimensional view of block of the present invention provided with a cylindrical opening.

FIG. 9 is a three-dimensional view of a block 10 of the present invention provided with a cylindrical opening 34 extending inwardly to about the center of block 10.

Figure 10:
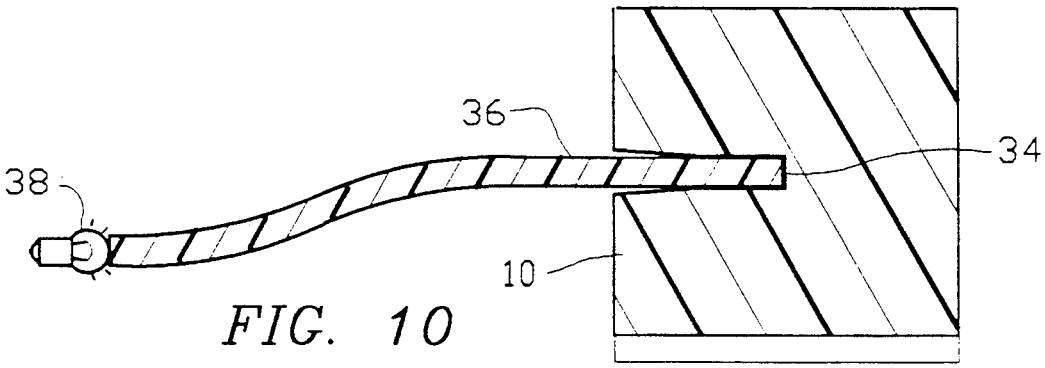
FIG. 10 is a cross-sectional view of the block of FIG. 9 with a light-conducting optic fiber engaging the opening.

In FIG. 10, opening 34 in a cross-sectional view of block 10 taken through axis A–A' of FIG. 9 is shown engaging an end of an optic fiber 36 which may be held in place by means of a frictional fit or fastened in place adhesively. When the opposite end of optic fiber 36 is illuminated by an electric lamp bulb 38 as shown, light is conducted through optic fiber 36 to provide an illuminated visual effect in block 10.

Figure 11:
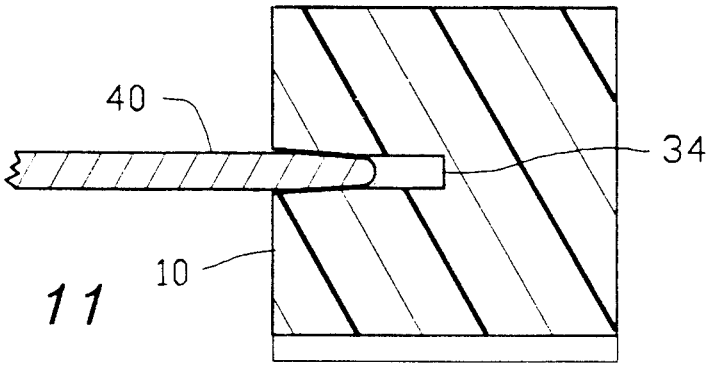
FIG. 11 is a cross-sectional view of the block of FIG. 9 with the tip of a handling tool engaging the opening.

In FIG. 11, opening 34 in the cross-sectional view of block 10 is shown frictionally engaging a handling tool tip 40 for handling the block 10 in assembly and inserting it into a workpiece, manually or automatically. Tool tip 40 is made slightly tapered, about 2 degrees, to interface with a matching flared entry portion provided in opening 34 as shown.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A plurality of graphic construction blocks, all having substantially identical X-Y plane cross-sectional shape, the shape being substantially square with four substantially identical sides, each side being configured to have, along a typical side extending between two adjacent corners of the square shape, a protrusion disposed in a first half of the side and a cavity disposed in a second half of the side, the protrusion and cavity being symmetrically displaced from a central point of the side, and being made complementary to each other in shape, each having a neck portion, based along a portion of the side, extending therefrom to an enlarged head portion, such that said blocks are enabled to interlock together on all sides to form a two-dimensional array in which each block serves as a basic structural and graphic element of an artifact thus formed, each of said blocks being made to have a designated length dimension along a Z-axis perpendicular to the X-Y plane and to be substantially uniform in cross-sectional shape throughout the length so as to enable the blocks to be assembled and disassembled by sliding displacement along the Z-axis.

2. The graphic construction blocks as defined in claim 1 wherein the length dimensions of all of said blocks are made equal such that a two-dimensional array may be formed therefrom having two parallel planar surface constituting opposite ends of said blocks.

3. The graphic construction blocks as defined in claim 1 wherein said blocks are made to have a dimension of length substantially equal to that of each of the sides so as to form the general shape of a cube.

4. The graphic construction blocks as defined in claim 1 comprising a plurality of said blocks selected to have various individual visual attributes from a group of attributes including texture, color and light transmission including translucent and transparent properties, interlocked into a two-dimensional array constituting a graphics artifact in which each block serves as a picture element.

5. The graphic construction blocks as defined in claim 1 wherein the cross-sectional shape defines a first straight line portion extending along the side from a first corner of the block to a first neck edge of the protrusion, a second straight line portion extending along the side from a second neck edge of the protrusion to a first neck edge of the cavity, and a third straight line portion extending along the side from a second neck edge of the cavity to an adjacent second corner of the block, the first, second and third straight line portions being colinear.

6. The graphic construction blocks as defined in claim 1 wherein the cross-sectional shape defines a first straight line portion extending along the side from a first corner of the block to a first neck edge of the protrusion, a contiguous junction of the second neck edge of the protrusion with a first neck edge of the cavity, and a second straight line portion extending along the side from a second neck edge of the cavity to an adjacent second corner of the block.

7. The graphic construction blocks as defined in claim 1 wherein said blocks are assembled together in a two-dimensional array supported in a frame surrounding the array, the frame having a planar backing member and each of said blocks having an end abutting the backing member.

8. The graphic construction blocks as defined in claim 1 wherein said blocks are made in a variety of Z-axis lengths, so as to enable creation of a three-dimensional surface pattern on at least one side of a two-dimensional array of said blocks interlocked together.

9. The graphic construction blocks as defined in claim 1 wherein:

the cross-sectional shape defines a first straight line portion extending along the side line from a first corner of the block to a first neck edge of the protrusion, a second straight line portion extending along the side line from a second neck edge of the protrusion to a first neck edge of the cavity, and a third straight line portion extending along the side line from a second neck edge of the cavity to an adjacent second corner of the block, the depth dimensions of all of said blocks are made equal, and said blocks are selected from a group having various individual visual attributes including texture, color and light transmission including translucent and transparent properties, whereby a two-dimensional interlocked array formed from said blocks may be made to create a graphics artifact having two parallel planar surfaces formed at opposite ends of said blocks in which each block serves as a picture element.

10. The graphic construction blocks as defined in claim 9 wherein said two-dimensional array of said blocks is assembled in a frame surrounding the array, the frame having a planar backing member and each of said blocks having an end abutting the backing member.

11. The graphic construction blocks as defined in claim 9 wherein said two-dimensional array of said blocks, including at least a predominant proportion of translucent blocks of various selected colors, is sandwiched between two transparent panels retained by a surrounding frame, so as to provide a stained glass window effect.

12. The graphic construction blocks as defined in claim 1, wherein said blocks are injection molded from plastic material, each block further comprising:

a circular protruding nub, originating as a residue from injection molding of the block, located on a surface interfacing an adjacent block and utilized to facilitate assembly and enhance mutual retention of the blocks by providing a frictional engagement effect at interfacing surfaces of said blocks.

13. The graphic construction blocks as defined in claim 1, wherein at least some surfaces of at least some of said blocks are made to have a mirror-quality finish so as to reflect light and thus enable said blocks under illumination, to provide a distinctive, bright-appearing optical effect.

14. The graphic construction blocks as defined in claim 1, wherein said blocks are each provided with a generally cylindrical opening in a surface thereof to serve at least one of the following two functions: engagement of an insertion tool tip for assembly of said blocks and engagement with an optic fiber end.

15. A plurality of graphic construction elements, all having a substantially identical cross-sectional shape in an X-Y plane, the shape being substantially square with four substantially identical sides, each side being configured to have, a protrusion and a cavity disposed adjacent to each other symmetrically about a central point of the side, the protrusion and the cavity being made complementary to each other in shape, each having a neck portion, based along a portion of the side, extending therefrom to an enlarged head portion, such that said blocks are enabled to interlock together on all sides to form a two-dimensional array in which each block serves as a basic structural and graphic element of an artifact thus formed, each of said blocks being made in a variety of designated length dimensions along a Z-axis perpendicular to the X-Y plane and being made substantially uniform in cross-sectional shape throughout the length so as to enable the blocks to be assembled into three-dimensional artifacts by sliding displacement along the Z-axis.

* * * * *